United States Patent [19]

Van Meter

[11] 3,949,989

[45] Apr. 13, 1976

[54] BRISTLED DART AND SPIKED BOARD

[76] Inventor: James A. Van Meter, 15357 Magnolia, Van Nuys, Calif. 91403

[22] Filed: Oct. 2, 1974

[21] Appl. No.: 511,487

[52] U.S. Cl. ..... 273/95 R; 273/106.5 A; 273/102 B

[51] Int. Cl.[2] ..... A63B 71/00

[58] Field of Search ..... 273/95 R, 102 R, 102 B, 273/106.5 R, 106.5 A, 106.5 B

[56] References Cited

UNITED STATES PATENTS

| | | | |
|---|---|---|---|
| 1,075,264 | 10/1913 | Morrison | 273/102 B |
| 1,737,871 | 12/1929 | Vaughan | 273/106.5 A |
| 2,940,759 | 6/1960 | West | 273/106.5 B |
| 3,829,094 | 8/1974 | Goldfarb | 273/102 B |

FOREIGN PATENTS OR APPLICATIONS

| | | | |
|---|---|---|---|
| 775,002 | 1/1968 | Canada | 273/102 B |
| 887,444 | 1/1962 | United Kingdom | 273/102 B |

*Primary Examiner*—Anton O. Oechsle
*Assistant Examiner*—Marvin Siskind

[57] ABSTRACT

A dart game wherein the dart board includes a large number of sharpened spikes protruding outwardly from the surface of the dart board, a dart to be thrown upon the board, the head of the dart comprising a bundle of tightly packed bristles, mounted within an open ended tube, the dart to be propelled through the air with the dart adhering to the dart board by one or more of the spikes penetrating the bristles causing the dart to adhere to the board.

3 Claims, 5 Drawing Figures

BRISTLED DART AND SPIKED BOARD

BACKGROUND OF THE INVENTION

Dart games have long been in use. The conventional form of such a dart game employs a dart board, usually made of cork, paper, or hair, and a plurality of sharp pointed darts. These darts are propelled through the air with the sharp point of the dart to penetrate the dart board.

The sharp point of the dart is not only capable of causing damage to physical objects, but can also cause injury to persons. It is not uncommon for the injuries to include loss of a person's sight from the sharp pointed steel dart being misguided when thrown. Also, other injuries have frequently occurred, such as the sharp point of the dart penetrating another portion of a person's body. Also, it has been known that people have used the sharp pointed darts purposely to injure somebody, or to cause damage to material objects.

In the past, there have been attempts at designing a dart game wherein the sharp point of the dart was eliminated. One such game employed a magnetic dart board with the darts having magnetic heads. However, frequently, the magnetic darts will bounce off of the dart board. Also, the darts frequently move or slide upon the board immediately after initial contact which can substantially change the player's score.

Another type of prior art dart board employed suction cup darts. Such suction cup type of darts frequently bounce off of the board and even if the dart does stick to the board, after a period of time the dart may simply fall from the board.

At the present time, many retail outlets do not have for sale the dart games which employ sharp pointed darts. The reason for this is the hazard that such sharp pointed darts present and also possible lawsuits which may accrue due to the use of such sharp pointed darts.

There is a definite need for a dart game wherein the sharp pointed dart is eliminated and yet when playing the game the dart can fly to the board with a high degree of accuracy and upon striking the board in a given area will remain located at that particular spot on the dart board until it is actually physically removed therefrom.

SUMMARY OF THE INVENTION

The structure of this invention relates to the use of a dart board which employs a plurality of closely spaced spikes protruding out from the surface of the dart board. These spikes will normally be about one half inch in length and will entirely cover the playing area of the dart board. Each of the darts that are employed in conjunction with the board of this invention include an elongated shaft which at one end is feathered or finned to facilitate accurate propelling of the dart through the air. At the opposite end of the shaft of the dart, or at the head of the dart, the dart includes a bundle of bristles located in a tightly packed arrangement. The bundle of bristles are enclosed within a casing. The casing may be removable to facilitate replacing of the bundle of bristles. When the dart is propelled to the dart board, one or more of the spikes are to penetrate the bristles thereby supporting the dart upon the board. Instead of the bristles, other means could be employed which the spikes could penetrate, such means comprising by way of example, steel wool, wood, cork or other similar type of penetrable material. In the preferred embodiment of this invention, the bundle of bristles may take the form of plastic rods or plastic flat bars, or metallic rods or bars. A handle shield may be employed which is to be held against a few of the spikes of the dart board to firmly keep the board in place during removal of the darts. The shield serves to keep the person's fingers away from the tip of the spikes.

BRIEF DESCRIPTION OF THE SHOWN EMBODIMENT

Figure 1:
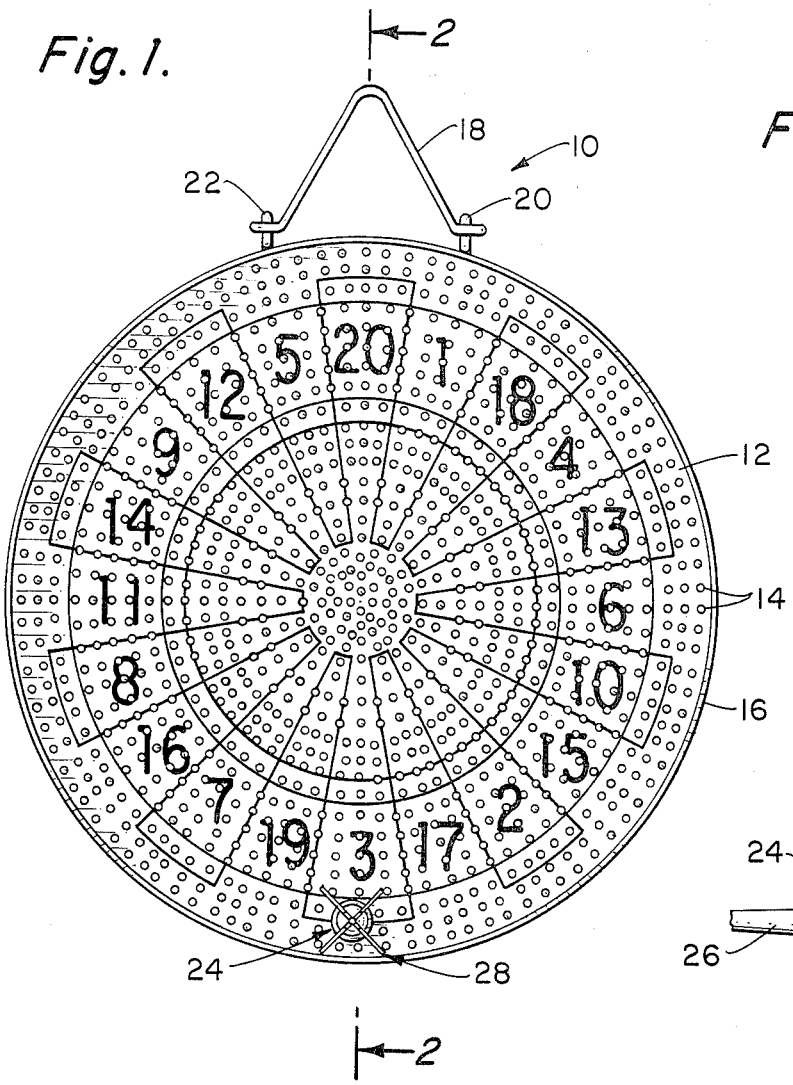
FIG. 1 is a front view of the dart board employed within the dart game of this invention.
Figure 2:
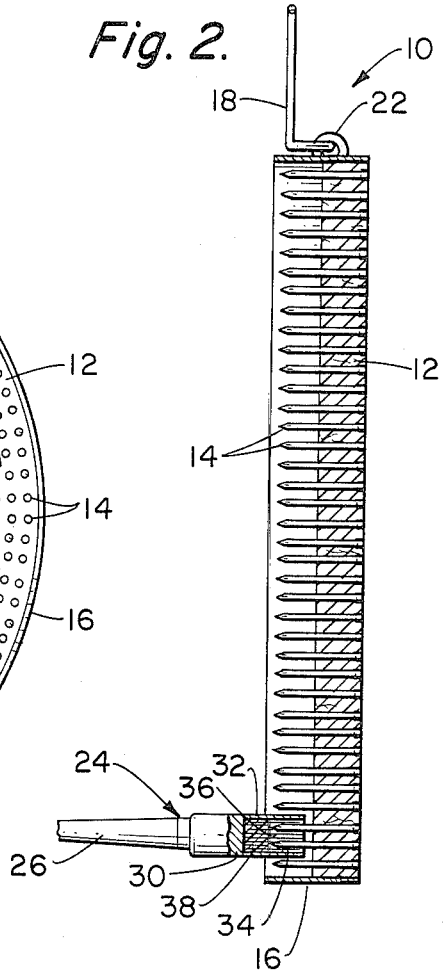
FIG. 2 is a cross-sectional view taken along line 2—2 of FIG. 1.
Figure 3:
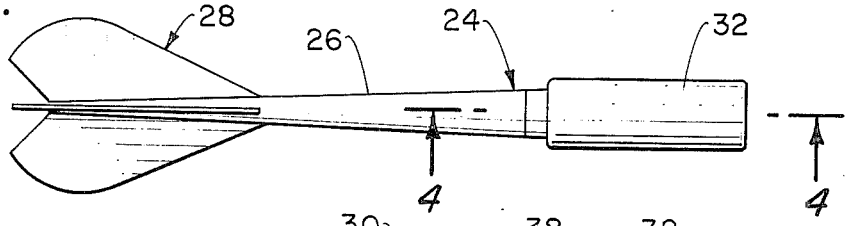
FIG. 3 is a elevational view of the type of dart employed within the dart game of this invention.
Figure 4:
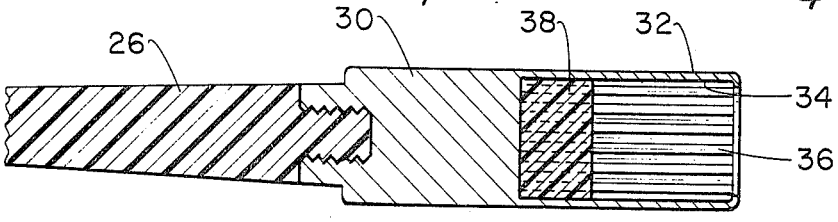
FIG. 4 is a cross-sectional view taken along line 4—4 of FIG. 3.

Referring particularly to the drawing, there is shown the dart game of this invention which includes the use of a dart board 10. The dart board 10 includes a conventional board 12 which is formed of a rigid material such as wood or plastic. The board 12 is in the form of a circle and has an outer surface upon which are located a plurality of scoring areas which includes appropriate scoring indicia. The scoring pattern of the board 12 can be any particularly desired pattern. The dart board 12 could be shaped square, rectangular or oval for other types of dart games other than the familiar English dart game.

Extending through the board 12 are a plurality of spikes 14. Actually there are several hundred spikes 14 completely covering the scoring area of the board 12. The pointed end of the spikes 14 extend about a half an inch outward from the scoring surface of the board 12. The spikes 14 are positioned substantially perpendicular with respect to the plane of the scoring surface of the board 12. However, it is considered to be within the scope of this invention to have some or all of the spikes 14 positioned at an angle with respect to the scoring surface of the board 12. The spikes 14 are positioned approximately one fourth inch apart. However, the spacing is to be flexible and a closer spacing or a wider apart spacing may be employed.

Surrounding the periphery of the board 12 is a guard rail 16. The height of the guard rail 16 is at least as great as the height of the spikes 14 and in the embodiment shown in the drawing is slightly greater in height than the spikes 14. The rail 16 is of a thin rigid material. The rail 16 is to prevent the spikes 14 from causing injury to persons or to prevent damage to material goods if the dart board 10 is placed face down upon a table or other supporting surface.

The guard rail 16 is secured to the board 12 as by nails or other similar securing means.

Attached to the upper end of the dart board 10 is a hanger 18. The hanger 18 is secured by means of eyelets 20 and 22 through the guard rail 16 into the board 12. By the use of the eyelets 20 and 22 the hanger 18 is retractable to the back side of the board 10, if it is desired. The hanger 18 is to facilitate hanging of the dart board 10 upon a vertical surface, such as a wall.

Employed in conjunction with the dart board 10 is a plurality of darts, such as the dart 24. The dart 24 includes a dart shaft 26, the aft end of which is formed into a finned area 28. The finned area 28 is to facilitate traveling of the dart 24 through the air.

The forward end of the shaft 26 is screw threadingly secured to a ballast member 30. The ballast 30 is normally formed of a metal material and will, in most instances, be solid. Integrally formed at the free outer end of the ballast 30 is a metal casing 32. An interior chamber 34 is formed within the metal casing 32.

Located within the chamber 34 is a tightly packed bundle of bristles 36. The bristles 36 will normally be of plastic bars or rods. The bundle 36 is glued tightly at base 38 to prevent disassociation of the bundle 36. Once located within the chamber 34, the outer end of the casing 32 is crimped over the the forward outer edge of the bundle 36 in order to prevent the bundle 36 from being removed from the chamber 34.

Figure 5:
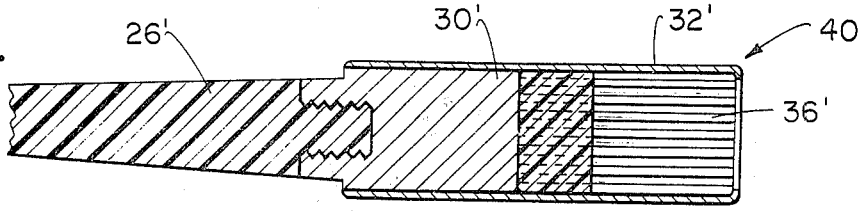
FIG. 5 is a cross-sectional view similar to FIG. 4 but of a modified form of dart wherein the bundle of bristles is replaceable.

Referring in particularly to FIG. 5 of the drawing, a modified form of dart 40 is shown. Like numerals have been employed to refer to like parts. The distinction of the dart 40 from dart 24 is that the casing 32' is formed separately from the ballast 30'. This permits disassociation of the casing 32 from the ballast 30' to effect replacement of the bundle 36'. If perchance the bundle 36' becomes to worn, it can be replaced with dart 40 within FIG. 5.

Once the dart 24 or 40 is propelled through the air and caused to become impaled upon one or more of the spikes 14, the dart might be so tightly impaled thereon that it may be difficult to remove the dart from the dart board 10 unless it is fixed to the wall. Therefore, it may be preferable that some separate tool be employed to be placed against some of the spikes 14 during removal of the dart. This separate tool is to exert a force counter to the removal force of the dart tending to keep the dart board 10 in its correct vertical position. Such a tool is not shown in the drawing.

What is claimed is:

1. A dart game comprising:

a dart board, said dart board having a scoring surface thereon, a plurality of spikes secured to said board and protruding above said scoring surface, said spikes arranged in an evenly spaced apart manner totally across said scoring surface;

a dart adapted to be thrown through the air and to be impaled upon one or more of said spikes, the forward end of said dart including a penetrable material, said penetrable material comprising a bundle of tightly packed bristles, whereby one or more of said spikes are to penetrate said penetrable material and rigidly support said dart with respect to said board; and said dart including a removable casing, said bundle of bristles being contained within said casing, whereby said casing may be removed to replace said bundle of bristles.

2. The dart game as defined in claim 1 wherein:

said spikes being located substantially perpendicular to said scoring surface, each of said spikes extending a length of approximately one half an inch above said scoring surface; and a guard rail attached to the periphery of said dart board, the height of said guard rail being slightly greater than the height of said spikes.

3. The dart game as defined in claim 2 wherein:

an eyelet assembly protruding from the exterior of said guardrail, a hanger pivotally connected to said eyelet assembly, said hanger being movable adjacent the aft side of said dart board.

* * * * *